US005613556A

United States Patent [19]

Sable et al.

[11] Patent Number: 5,613,556

[45] Date of Patent: Mar. 25, 1997

[54] ROD GUIDE AND METHOD OF AN APPARATUS FOR INSTALLING IT ON THE SHANK OF A ROD

[75] Inventors: Donald E. Sable, Dallas, Tex.; Donald E. Sable, II, Oklahoma City, Okla.

[73] Assignee: T. McClung-D. Sable Partnership, Dallas, Tex.

[21] Appl. No.: 518,592

[22] Filed: Aug. 14, 1995

[51] Int. Cl.[6] ..... E21B 17/10

[52] U.S. Cl. ..... 166/241.4; 175/325.1

[58] Field of Search ..... 166/241.1, 241.2, 166/241.4, 241.5, 241.6; 175/325.1, 325.5

[56] References Cited

U.S. PATENT DOCUMENTS

| | | | |
|---|---|---|---|
| 1,583,262 | 5/1926 | Smith | 166/241.2 |
| 4,997,039 | 3/1992 | Sable | 166/241.4 |
| 5,115,863 | 5/1992 | Olinger | 166/241.5 |
| 5,191,938 | 3/1993 | Sable et al. | 166/378 |
| 5,339,896 | 8/1994 | Hart et al. | 166/241.1 |
| 5,358,041 | 10/1994 | O'Hair | 166/241.4 |
| 5,452,760 | 9/1995 | Bertagnolli | 166/176 |

*Primary Examiner*—Frank Tsay

[57] ABSTRACT

A guide for the rods of a rod string having a plurality of of units spaced longitudinally on the shank of the rod to provide a flex rod portion therebetween and a method of and apparatus for installing the guide unit on the shank.

10 Claims, 5 Drawing Sheets

ROD GUIDE AND METHOD OF AN APPARATUS FOR INSTALLING IT ON THE SHANK OF A ROD

This invention relates to well tools and more particularly to guides for the rods of a sucker rod string for maintaining the rod in substantially central position in a well tubing during reciprocal movement of the sucker rod string in the well tubing and to the method of and apparatus for installing the rod guides on the rods.

BACKGROUND OF THE INVENTION

The usual apparatus for pumping well fluids from a well to the surface through a tubing, which extends from the surface to a fluid producing formation penetrated by the well, includes a pump connected to the lower end of the tubing which has a plunger or "traveling valve" which is reciprocated in the longitudinal barrel of the pump by a string of sucker rods, the bottom rod being connected to the traveling valve, the top rod of the rod string being connected to a motor driven means for alternately pulling the string upwardly and then allowing the string to be moved downwardly by gravity.

Since the weight of the pump rod string provides the force necessary to cause well fluids to flow upwardly through the tubing, if resistance to the downward movement of string of tubing by the upwardly flowing well fluids is great, especially past such obstructions to fluid flow as rod guides or scrapers mounted on the rods, the rod string will move downwardly relatively slowly thus reducing the rate of production of the well fluids. The rod guides of course decrease the flow space area between the rod and the tubing having radially outwardly extending longitudinal ribs for engaging the internal surfaces of the well tubing to limit the lateral displacement of the rod in the tubing. In addition, if the pump and lower end portions of the rod string offer a relatively great resistance to downward movement of the rod string, the weight of upper portions of the rod string may cause lower portions of the rod string to be placed under great compression loads which tend to cause such lower portions to bend and buckle and their rod guides to be moved lateral and pressed with great force against the internal surfaces of the tubing.

The rod guides at locations where the rod is not centrally positioned in the well tubing rub against the internal surfaces of the well tubing over the distance, for example, six feet, of the reciprocal movement of the sucker rod string during pumping operation. The rod guides accordingly must be formed of a substance which is hard and durable, but which does not have such abrasive characteristics as to abrade or erode the well tubing to such an extent that the well tubing is damaged and even broken. The substance of which the rod guides are formed must also be durable so that the rod guides themselves are not worn away or eroded in relatively short time period of the reciprocating operation of the rod string.

Since the well tubing itself may not be perfectly vertical and be bent at various locations along its length the rod guides must limit the lateral displacement of the rod relative to the central longitudinal axis of the well tubing at such locations. The ribs of the rod guides at locations of deviated or bent portions of the tubing or of the rod string will abrade or erode since they slide in frictional engagement with the internal surfaces of the well tubing. The two ribs of the rod guide which engage the well tubing at such locations would be worn away quickly and allow portions of the string, as at the locations of the upsets at the ends of each rod by which the rods are connected to one another, actually to come in metal-to-metal contact with the internal surfaces of the tubing and so damage the tubing as well as the rods themselves.

In many installations the well head equipment at the surface of the well includes a rotator which rotates the rod string a few degrees in a step by step manner so that all ribs are sequentially moved into contact with the internal surfaces of the well tubing at such locations of the curvature or lateral displacement of the tubing or the rod string so as to lengthen the time before the failure of the rod guide due to excessive wear of its ribs.

At some locations of lateral displacement of the rod guide string relative to the longitudinal axis of the tubing, the two guide ribs which engage the internal surfaces of the tubing to limit such lateral displacement may be held with such great force against the internal surface of the well tubing that the portions of the rod string between such rotator and such rod guide may actually twist 360 degrees or more, especially if the length of such portions are of great length, a thousand or more feet, before sufficient torque force is exerted on the rod to cause the rod at such location to be rotated until the violently and rapidly engagement of another rib with the well tubing again limits such lateral displacement and rotation. Once the rotation of the rod has started, the rod may rotate rapidly relative to the tubing with consequent damage to the tubing and the ribs which engage it during such violent rotation of the rod string.

It is also desirable that in one form the rod guide of the invention have means for ensuring that during the rotation of the rod string at least two ribs radially spaced ninety degrees apart be continuously in engagement with the well tubing at the locations of lateral displacement of the rod string relative to the well tubing in order to prevent abrupt rotational movement of the rod as a pair of the ribs moves out of engagement with the tubing before another pair engages the tubing since abrupt jerking rotation of the rod string may actually cause damage to the rod guides and to the well tubing.

The rod guides also must not cause excessive torque forces to be exerted on the rods at such locations since the tubing is circular and tends to force or torque one rib in one direction about the longitudinal axis of the rod shank so that a second rib of the rod guide must be so positioned and engaged with the internal surface of the well tubing as to provide a torque force acting in the opposite direction so that the rod string itself is not rotated or twisted by the great forces exerted on the rod guide.

In addition, the rod guides should provide a relatively low resistence to upward flow of well fluids therepast and therefore to the downward movement of the rod string in the tubing as has been disclosed in the U.S. Pat. Nos. 4,809,777 and 4,997,039 to Donald E. Sable. The rod guides should also minimize the turbulence in the well fluids flowing therepast during the reciprocatory movement of the rod string in the well tubing which not only increases the resistence to upwardly flow of the well fluids, but also tends to wear away and damage the rods of the rod string and the internal surfaces of the well tubing, specially if the well fluids include abrasive particles, such as sand, or corrosive chemicals.

The plastic substances available and suitable for use to form the rod guides are hard and durable, but somewhat brittle so that the length of the bodies of the rod guides which regidify the longitudinal portions of the rod shank on which they are rigidly mounted are limited because the rods are pressured to bend laterally thus cracking the bodies of the rod guide.

The ribs of the rod guides which engage the internal surfaces of the well tubing should preferably provide a fairly large area of contact with the well tubing at locations of their sliding engagement therewith in order to minimize the per unit area pressure or force with which the ribs are forced into engagement with the well tubing, both to minimize wear of the ribs and the wear and abrasion of the well tubing itself.

While the rod guides disclosed in the U.S. Pat. No. 4,997,039 to Donald E. Sable minimizes the damage to the elongate rod guide body caused by the bending of the rod by providing a circular area of low mechanical strength and decreased radius in order to cause any such damage or cracking of the rod guide to be limited to a central area between two longitudinally spaced pairs of guide ribs, the cracking of the body at such locations of the rod guide body exposes the rod at the locations of such cracks to the well fluids and increases the turbulence thereof at such locations. The rods are cleaned of all dirt and coating substances in order to prevent outgasing therefrom and provide great adherence of the guide bodies to the rod shanks. Since the rod is not coated with any corrosion inhibiting material beneath the rod guides, such exposed portions of the rod are more susceptible to damage by turbulence, chemical action and abrasion by abrasive particles in the well fluids.

It is desirable therefore that each rod guide be provided with two pairs of longitudinally spaced units each having a body provided with a pair of diametrically outwardly extending radial ribs, the ribs of one unit being displaced ninety degrees about the longitudinal axis of the rod shank from the ribs of the other unit and spaced on the rod shank so that a flex portion of the rod shank between the two units of the rod guide be free to accommodate any lateral forces exerted thereon, the two bodies of course regidifying the portions of the rod shank above and below such flex portion.

It is also desired that rod guides having such two separate units be installable or molded simultaneously on a rod shank in order to achieve economies in time of manufacture, the molding process requiring the injection of hot molten plastic into cavities of the molding apparatus which then must be cooled sufficiently before the molding equipment can again be used to form another rod guide on the same shank and spaced from the previously molded rod guide on the same rod shank by some distance, for example, six feet or more.

OBJECTS OF THE INVENTION

It is therefore an object of this invention to provide rod guides for the rods of a pump rod string which will limit lateral displacement of the rods in a well tubing.

It is another object of the invention to provide a rod guide having at least two longitudinally spaced units, each having a pair of diametrically oppositely outwardly extending ribs, the ribs of one unit being displaced ninety degrees from the ribs of the other unit, the portion of the rod shank between the two rod guide units constituting a flex section.

Another object of the invention is to provide a rod guide, of the type described, wherein each unit of the rod guide has an elongate body provided with turbulence reducing end portions which extend divergently inwardly to the rod shank from the opposite end portions of the body.

Another important object of the invention is to provide a new and improved method of installing a pair of longitudinally spaced rod guide units on the shank of a rod.

Still another object is to provide a new and improved method for installing a rod guide on the shank of a rod by positioning the rod through a pair of spaced cavities of an injection mold and simultaneously injection a hot plastic substance into the cavities and about the rod shank and allowing the substance to solidify.

Another important object of the invention is to provide a new and improved apparatus for molding two longitudinally spaced rod guide units on the shank of a rod.

SUMMARY OF THE INVENTION

A rod guide assembly for the shank of a rod having at least two units longitudinally spaced on the rod shank, the portion of the rod shank between the two units constituting a flex section of the rod, the two units each having a body and a pair of ribs extending radially outwardly in opposite directions, the ribs of one unit being displaced circumferentially from the ribs of the other unit whereby at least two ribs radially spaced not more than ninety degrees from each other will engage the internal surfaces of the well tubing where the rod guide is displaced laterally from the central longitudinal axis of the well tubing to limit such displacement of the rod.

The method of installing a pair of longitudinally spaced rod guide units on the shank of a rod by positioning the rod shank through a pair of spaced cavities of a mold and injecting a hot plastic material into the cavities and about the rod shank.

An injection molding apparatus having at least two longitudinally spaced cavities through which a rod shank is positionable and having means for injecting a hot plastic material into the cavities to form guide units on the rod, each guide unit having a pair of ribs extending diametrically outwardly in opposite directions with one pair of the ribs of one unit being displaced ninety degrees about the longitudinal axis of the rod relative to the ribs of the other unit.

DESCRIPTION OF THE DRAWINGS

Other objects and advantages of the invention will be readily apparent from the reading of the following descriptions of rod guides constructed in accordance with the invention and reference to the accompanying drawings:

Referring now to FIGS. 1–4A of the drawings, the rod guide 10 embodying the invention, shown mounted on the shank 11 of a sucker rod SR, includes an upper unit 13 and a lower unit 13*a* spaced longitudinally from one another on the shank. The upper unit includes a tubular body 14 whose opposite upper and lower tapered end portions 16 and 17, respectively, extend divergently inwardly to the rod from the upper and lower ends of the central tubular body portion 18. A pair of ribs 21 and 22 extend radially outwardly in diametrically opposite directions from the cylindrical outer surface of the central body portion 18. The top end surfaces 26 and 27 of the ribs 21 and 22, respectively, extend substantially arcuately and downwardly from the lower end of the end portions 16 to the vertical surfaces 28 and 29 of the ribs 21 and 22, respectively. Similarly, the bottom end surfaces 31 and 32 of the ribs 21 and 22, respectively, curve upwardly and inwardly to the lower ends of the vertical surfaces 28 and 29, respectively, from the upper end of the lower end portion 17.

The lower unit 13*a* of the rod guide is identical in structure to the upper unit 13 and, accordingly, its elements and surfaces have been provided with the same reference numerals, to which the subscript "a" has been added, as the corresponding elements and surfaces of the upper unit 13.

Figure 1:
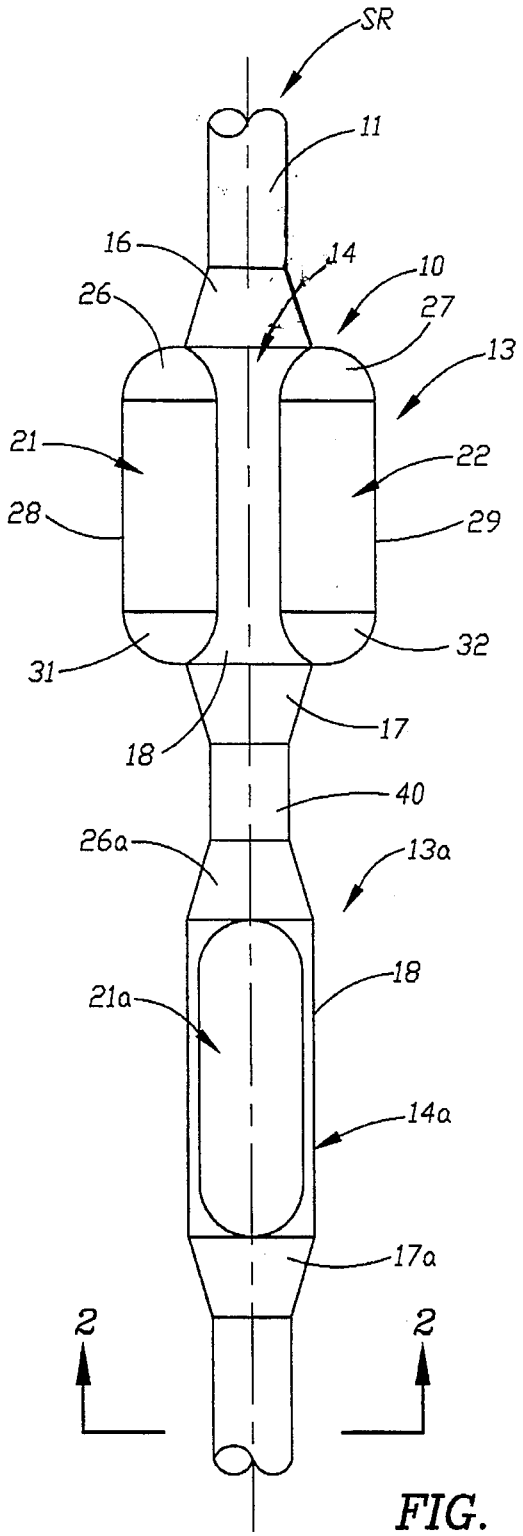
FIG. 1 is a longitudinal plan view of a rod guide embodying the invention shown mounted on a shank of a sucker rod.

The lower unit 13*a* is spaced longitudinally from the upper unit 13 to provide a bend or flex portion 40 of the shank, between lower and upper end portions 17 and 26*a* of the two units, which is free of the rigid bodies of the two units and is thus free to flex or bend to the degree permitted by the engagement of the ribs of the two units with the internal surfaces of the tubing in which the rod extends and is longitudinally reciprocable therein. The ribs 21*a* and 22*a* of the lower unit are displaced axially ninety (90) degrees about the longitudinal axis of the rod relative to the ribs 21 and 22 of the upper unit as shown in the drawings.

Figure 3:
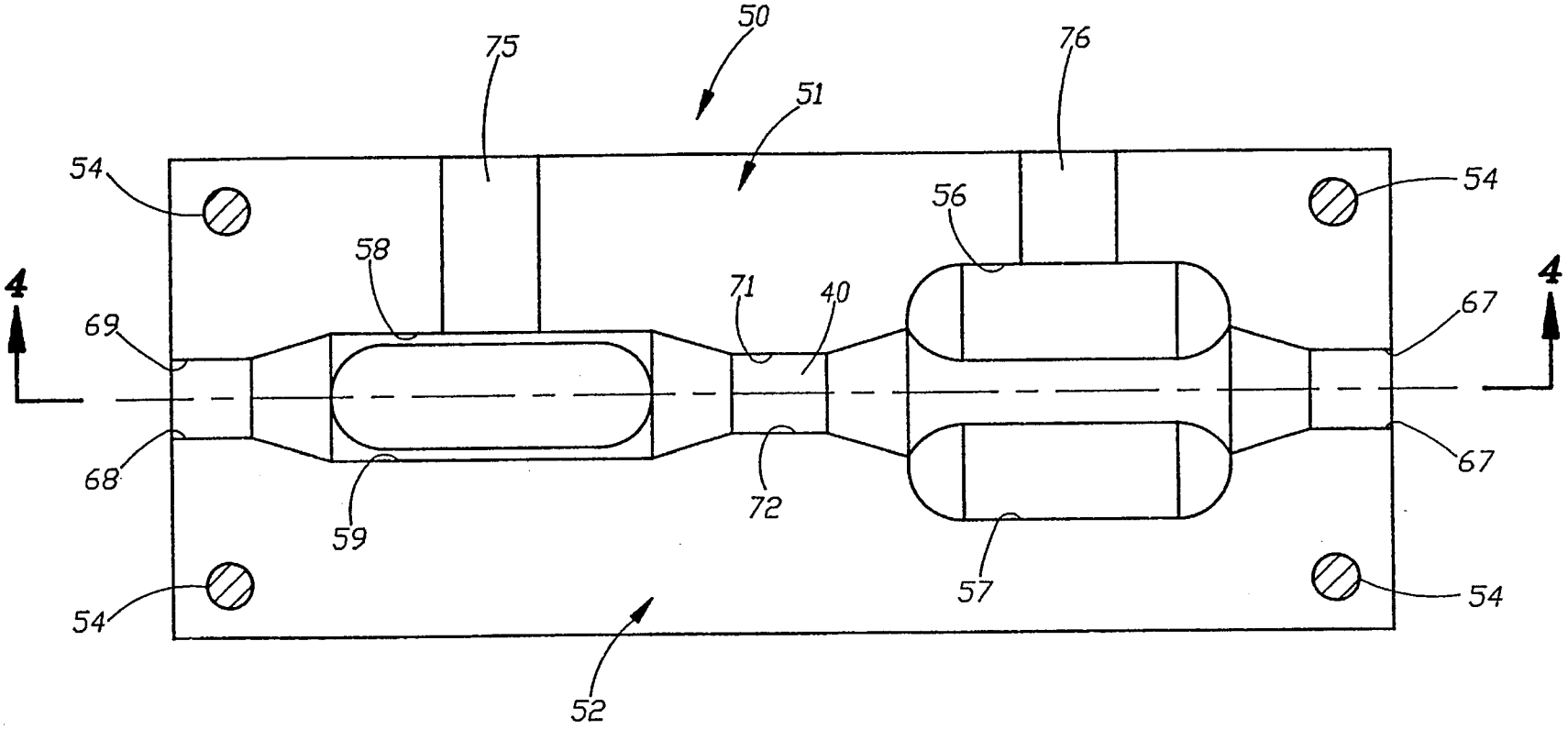
FIG. 3 is a schematic vertical view taken on line 3—3 of FIG. 4A of a stationary block or platen of the injection mold used to install the rod guide of the invention on the shank of a rod and showing the rod and the rod guide installed on the shank of a rod.
Figure 4A:
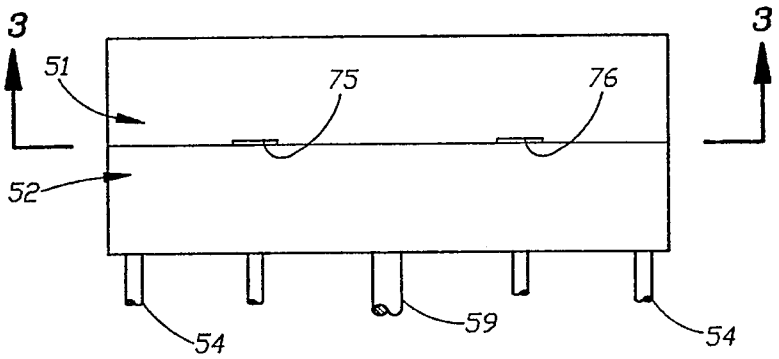
FIG. 4A is a top view take on line 4A of the mold apparatus.
Figure 4:
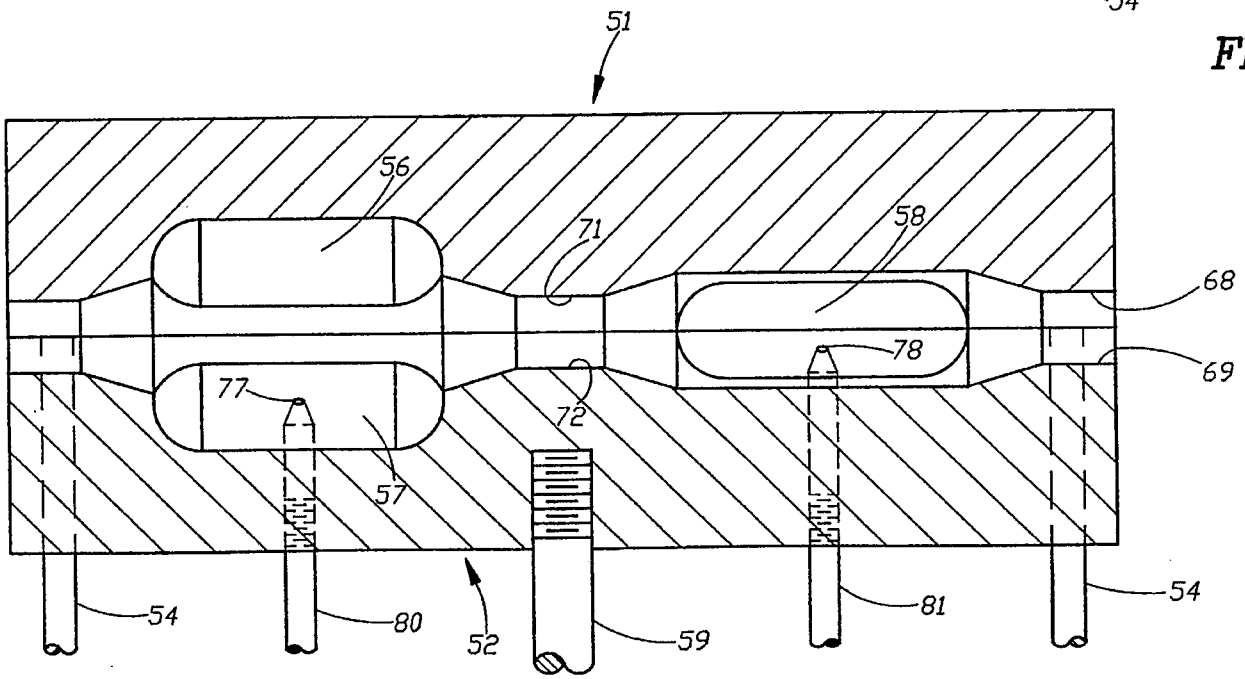
FIG. 4 is a schematic sectional view of the horizontally movable block or platen of the injection mold.

Referring now to FIGS. 3 and 4A of the drawings, the mold apparatus 50 for simultaneous molding the two guide units on the shank of the sucker rod is shown schematically as having stationary and movable platens or blocks 51 and 52. The movable block is mounted for horizontal movement relative to the stationary block on slide bars and posts 54, rigidly secured to the stationary block which extend slidably through suitable apertures in the movable block.

The two blocks 51 and 52 have pairs of aligned recesses 56 and 57 and 58 and 59, respectively, which when the movable block is moved as by means of the shank 59 into engagement with the stationary block 51 form a pair of cavities 61 and 62 having the configuration of the guide units 13 and 13*a*, respectively.

The cavities 61 and 62 are closed at their opposite ends when the rod shank extends through the mold, the blocks having arcuate semi-circular surfaces 66 and 67 at one of the ends of the blocks and similarly, semi-circular surfaces 68 and 69 at the other ends of the two blocks. They also have corresponding central arcuate surfaces 71 and 72 which also sealingly engage the shank of the rod and define the length of the intermediate flex or bend portion of the shank between the two units.

The molding apparatus has been shown schematically and it will be well known to those skilled in the art that suitable seal inserts may be provided to form the surfaces 66 and 67, 68 and 69, and 71 and 72, which will engage the rod shank and prevent any flow of plastic liquid therepast. It will also be apparent to those skilled in the art that the two blocks may be provided with cooling means, such as passages through which cooling liquids may be pumped, after the injection of the plastic into the cavities and about the rod shank, to shorten the time required for the plastic to solidify.

It will also be apparent to those skilled in the art that the mold apparatus, the block 51 and 52, may be provided with vent slots 75 and 76 to permit gases to escape from the cavities, but the slots are so narrow as to prevent flow of liquid plastic therethrough.

The hot liquid plastic substance is injected into the cavities 60 and 61 through sprues 77 and 78 to which the hot liquid substance under pressure is applied through flexible conduits 80 and 81 from a suitable pressurized source of the plastic substance.

The molding apparatus is shown schematically, its operation and structure, its various control's, heating and cooling means, being well known.

The guide units are formed of a tough durable plastic, such as polyphenylene sulfide, commercially available under the trademark "RYTON" or other rigid very durable plastic such as NYL/60/66 or a glass filled Nylon NYL/6/6 or the like.

Figure 2:
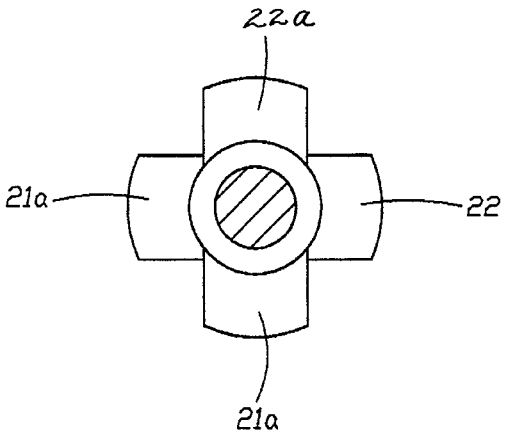
FIG. 2 is a cross-sectional view taken on line 2—2 of FIG. 1.
Figure 2A:
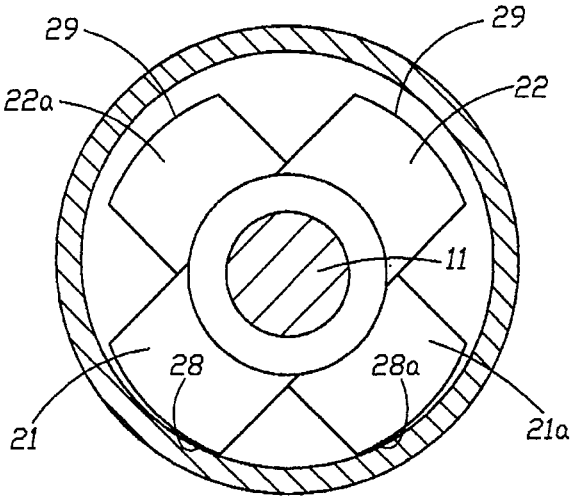
FIG. 2A is a schematic view showing the rod guide displaced relative to the longitudinal axis of a tubing in which it is disposed to limit such displacement, toward six o'clock as seen in FIG. 2A, relative to the longitudinal axis of the well tubing.

Referring now particularly to FIG. 2A of the drawings, it will be seen that if the rod shank 11 is displaced, downwardly or toward six o'clock as seen in FIG. 2A, the outer longitudinal surfaces 28 and 28*a* of the upper unit 21 and the lower unit 13*a*, respectively, engage the internal surface of the tubing T. A vector force due to the camming action between the surface 28*a* of the lower rib 21*a* will exert a torque force tending to rotate the rod shank 11 in a counter clockwise direction. At the same time the camming action between the outer longitudinal surface 28 of the rib 21 of the upper unit 13 will cause a torque force tending to rotate the rod 11 in a clockwise manner. As a result, the two torque forces will counter balance or offset each other so that the rod shank 11 is prevented from rotating.

It will be apparent for example that if one or the other unit 13 or 13*a* were not present, the force exerted on the of the remaining unit would be of such great force that it would twist or rotate the rod thus permitting additional displacement of the rod shank 11, toward six o'clock as seen in FIG. 2A.

It is of course preferable that the flex portion 40 of the rod between the two units 13 and 13*a* not be excessively long to minimize any excessive bending of the rod shank itself at the flex portion due to the fact that the two ribs in engagement with the internal surface of the tubing are spaced too far apart. It is preferable, however, that the flex portion 40 be of some length as to minimize the turbulence of the well fluids as they flow upwardly past the rod guide. The length of the flex portion 40 accordingly may be at least ½ inch long and of not more than 16 inches long. For this reason also the end portions 17 and 26*a* of the upper and lower units are preferably of at least ⅞ of an inch where the tubular portion 18 and 18*a* of the bodies 14 and 14*a* are approximately 4¾ inch in length.

It will be seen that the surfaces 28 and 28*a* of the ribs 21 and 21*a* will erode as they slide in contact with the internal surface of the tubing during the reciprocatory movement of the rod string while no wear will be occurring on the outer surfaces 29 and 29*a* of the ribs 22 and 22*a*. It will be apparent that the area of contacts of the ribs will increase as wear occurs on its surfaces 28 and 28*a*. The entire rod string is usually rotated at the surface by a well known rotator so that over a period of time so that all ribs are worn or eroded to excessive wear of any one rib. For example, in a clockwise manner as seen in FIG. 2A, the rib 21 will move into the position of that of 22*a*, and the surface 28*a* of the rib 21*a* will move to the previous position of that of the rib 21. The outer surface 29 of the rib 22 of the upper unit 13 will then of course move into the previous position of the rib 21*a*. The continuous very gradual rotation of the rod string will successively bring all ribs into sliding engagement with the internal surface of the well tubing at locations of displacement of the rod from the central longitudinal axis of the well tubing whether due to the bending of the well tubing itself or of the bending of the rod string as discussed above due to the great compressional forces exerted thereon.

As the rod is thus rate rotated the rib 21 will move out of engagement with the internal surface of the well tubing before the outer surface 29 of the rib 22 engages the internal surface of the well tubing to the force with which the ribs are pressed against the internal surfaces of the well tubing it is very great and the length of the rod string above the rotation of the engagement of the rod guide ribs with the well tubing is quite great, the rod shank may be held against rotation even though the upper end of the rod string is rotated through an appreciable angle sometimes more than 360 degrees as such upper portions of the rod string actually are twisted by the rotation. When the torque force tending to rotate the rod shank 11 at the location of the engagement of its rod guide ribs with the internal surfaces of the tubing becomes great enough to offset the great frictional force of which the rod guide units are held against rotation by their engagement with the internal surfaces of the well tubing the rod string will rotate very rapidly and violently before its rotation of the rod shank 11 again stopped by the engagement of the next rib 22 as shown in FIG. 2A with the internal surface of the tubing stopping rotation of the rod shank 11. In some cases where the upper portions of the rod string are twisted more than 360 degrees or as much as several complete turns, the rod shank also may rotate one or more turns once the rotation has begun as the frictional force of the engagement of the ribs with the well tubing is overcome. Such violent rapid rotation and violent engagement with the well tubing by the ribs of the units can of course damage the ribs themselves and the internal surfaces of the well tubing.

The width of the outer surfaces of the ribs, such as the surfaces 28 and 28*a*, determines the degree of normal rotation that takes place as one rib, such as 21, FIG. 2A, moves out of engagement with the well tubing and another rib, such as the rib 22, moves into engagement therewith. If the width of the ribs is increased to decrease the degree of such rotary movement the cross sectional area of the flow path or passage between the rod guide and the well tubing is of course decreased. This will result in increased velocity of flow of the well fluids past the rod guide and increase their turbulence.

Referring now to FIGS. 5A–5D and FIG. 6A, the rod guide 100 ensures that at all times during rotation of rod shank on which it is installed at least two ribs are in contact with the internal surfaces of the well tubing and thus prevents such rapid and violent rotation of the rod as the tubing string is rotated by the rotator. The rod guide 100 includes three units 103, 103*a* and 104 rigidly installed or molded on the shank 105 of a sucker rod. The middle unit 104 is spaced from the end units 103 and 103*a* to define the flex portions 106 and 107 of the shank.

The unit 103 has an elongate body 110 having end portions 111 and 112 which extend divergently inwardly to the shank from opposite ends of the body 110. A pair of ribs 115 and 116 extend in opposite directions from the middle portion 117 of the body. The rib 116 has side surfaces 118 and 119 which extend radially and divergently outwardly from the middle portion of the body 110 to an arcuate longitudinal outer surface 126. The rib 115 has end surfaces 122 and 123 which extend divergently inwardly from opposite ends of the surface 126 to the ends of the end portions 111 and 112, respectively, of the body 110. Similarly, the rib 116 has side surfaces 124 and 125 which extend radially divergently outwardly from the middle portion of the body 110 to its arcuate longitudinal outer surface 126 and end surfaces 129 and 130 which extend divergently inwardly from the opposite ends of the outer surface 126 to the inner ends of the body end portions 111 and 112, respectively.

The middle unit 104 has an elongate body 130*a* and end surfaces 131 and 132 which extend divergently inwardly from opposite ends of the body 130 to the shank and a pair or ribs 135 and 136 which extend in opposite radial directions from the body 130*a*. The ribs 135 and 136 have outer arcuate longitudinal surfaces 138 and 139, respectively. The rib 135 has the arcuate outer surface 138 and side surfaces 140 and 141. Similarly, the rib 136 has substantially parallel side surfaces 143 and 144. The ribs 135 and 136 have end surfaces 147 and 148, and 151 and 152, respectively, extending from opposite ends of the outer surfaces 138 and 139 to the body end portions 131 and 132, respectively.

The unit 130*a* having the same form as the unit 103 has been provided with the same reference numerals, to which the subscript "a" has been added, as the corresponding elements of the unit 103.

Figure 6A:
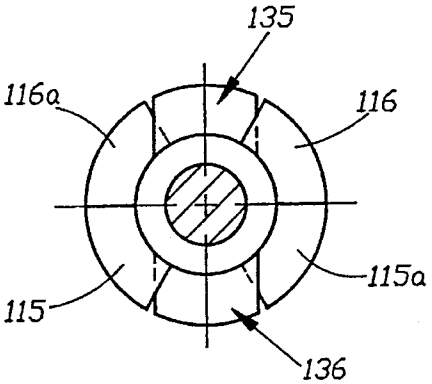
FIG. 6A is a sectional view taken on line 6A—6A of FIG. 5A.

Referring now particularly to FIG. 6A, it will be noted that as the shank is rotated at least two ribs of the three units will be at all in engagement with the internal surfaces of the well tubing that the violent swift rotation of the rod will not occur as is possible with the rod guide illustrated in FIGS. 1 and 2.

It will be noted that the rod guide 100 due to the provision of the third middle unit 104 has two flex portions 106 and 107 of the shank.

Figure 5A:
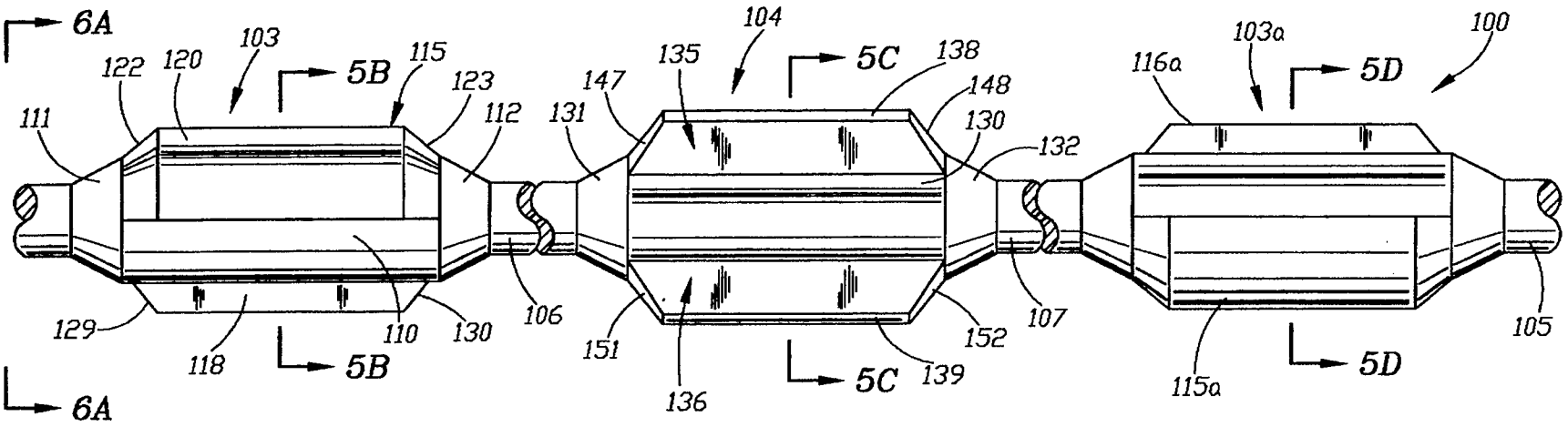
FIG. 5A is a plan view of a modified form of the rod guide embodying the invention having three units.
Figure 5D:
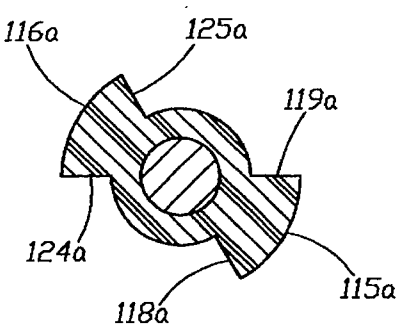
FIG. 5D is a sectional view taken on line 5D—5D of FIG. 5A.
Figure 5C:
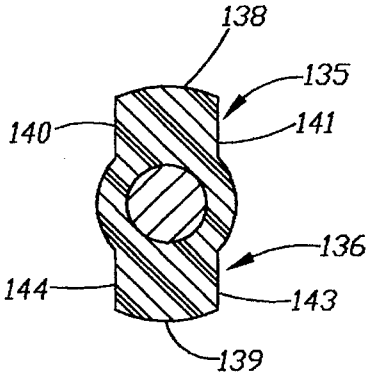
FIG. 5C is a sectional view taken on line 5C—5C of FIG. 5A.
Figure 5B:
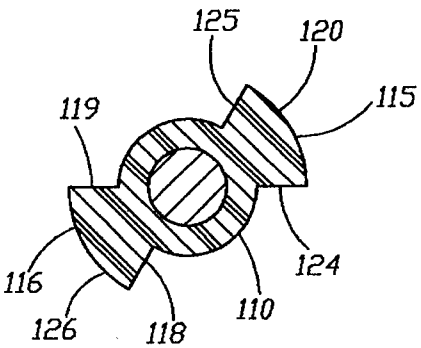
FIG. 5B is a sectional view take on line 5—5 of 5B—5B of FIG. 5A.
Figure 6C:
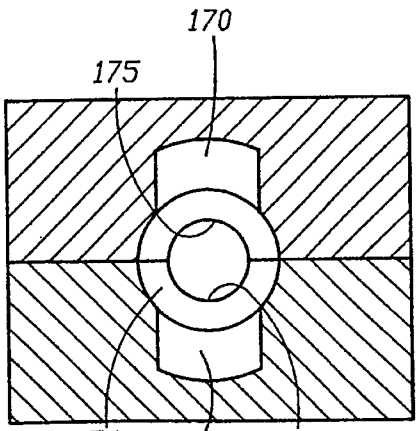
FIGS. 6B, 6C and 6D are schematic cross sectional views showing the cavities of the mold in which the three units of the rod guide of FIGS. 5A–5D are simultaneously installed on the rod.
Figure 6D:
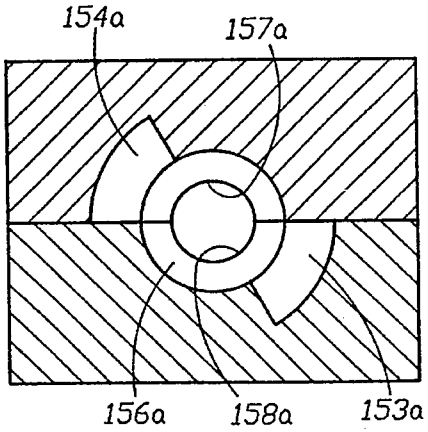
Figure 6B:
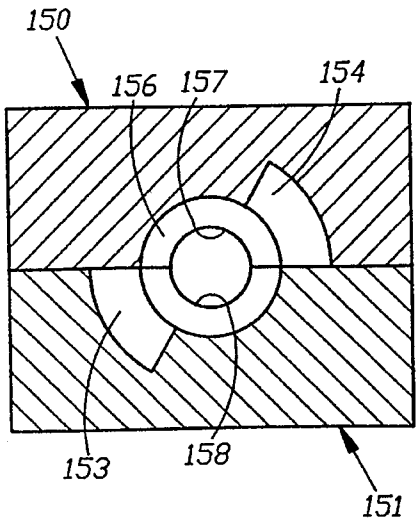

FIGS. 6B, 6D and 6C are schematic views showing the manner in which the cavities forming the three units are positioned in the mold apparatus for simultaneously molding the three units of the rod guide 100 onto the shank at approximately the same locations as were taken the view 5B, 5C and 5D of FIG. 5A. The mold apparatus has a stationary block or platen 150 and a movable platen or block 151 define cavities 154 in which are molded the ribs 115 and 116, respectively, of the guide unit 103, and the longitudinal cylindrical cavity 156 in which is molded the body 110. The blocks have surfaces 157 and 158 which sealingly engage the shank flex portion 106 of a rod at one end of the cavities 156. The other ends of the cavities 156 are similarly closed by the left end portion of the rod shank which extends from the apparatus. Similarly the block cavities 153*a* and 154*a* to which the ribs 115*a* and 116*a* of the unit 103*a* are formed and the circular recess cavity 156*a* having the seal surfaces 157*a* and 158*a* which sealingly engage the shank of the rod to sealingly engage the rod at its opposite right end portion and thus close the outer end of the cavity 156*a*. The inner ends of the cylindrical 156*a* cavity is similarly closed by similar arcuate surfaces of the mold which sealingly engage the right end portion of the rod shank.

The blocks 150 and 153 also have cavities 170 and 171 in which the ribs 35 and 136, respectively, are formed and a cylindrical cavity 174 in which the body 130 of the middle unit is formed. The blocks 150 and 151 have the arcuate surfaces 175 and 176 which sealingly engage the rod shank at one end of the flex portion 107 of the rod and similar recesses at the other end of the cylindrical recess which sealingly engage a portion of the rod at the other end of the flex portion 106 of the rod shank.

It will now be apparent that a new improved method for installing the rod guides includes positioning the rod shank through a plurality of mold cavities whose ends are closed by the rod shank, injecting simultaneously a hot molten plastic into the cavities allowing the substance to cool and solidify and removing the rod with the molded on rod guide from the mold apparatus.

It will also be apparent that a new and improved apparatus for installing rod guides having separate units spaced longitudinally on the rod shank has been illustrated and described.

It will be apparent to those skilled in the art that the apparatus includes two blocks providing two or more cavities one block away from the other to permit the removal of the rod with the molded on rod guide units from the mold has been illustrated and described, the various surfaces of the rod guide having a sufficient draft to permit movement of the movable block from the other after the guide units have solidified and which also permits removal of the rod guide with the molded on guide units from the stationary block.

It will also be seen that a new and improved rod guide rigidly installable on the shank of a rod has been illustrated and described which has a pair of units spaced longitudinally on the shank to define a flex portion of the shank therebetween.

It will further be seen that in the form of the rod guide illustrated in FIGS. 1 and 2, the two units of the rod guide each have a tubular body provided with turbulence reducing beveled end surfaces at opposite ends of the tubular body thereof which extend divergently inwardly from the tubular body and a pair of ribs which extend rigidly outwardly from the body in opposite directions, and that the ribs of one of the units are displaced 90 degrees about the longitudinal axis of the rod relative to the ribs of the other unit.

It will also be seen that in the form of the rod guide illustrated in FIG. 5A, the ribs of each unit has radially outwardly divergently extending side surfaces which increase the arcuate in cross section longitudinally extending outer surfaces of the ribs to provide greater widths of contact of the ribs with the internal surfaces of a well tubing when the rod shank is displaced laterally from the longitudinal central axis of the rod.

It will also be seen that the rod guide 100 has a middle unit spaced from its other end units to provide two flex portions of the rod at either end of the middle unit and that the provision of the middle unit ensures that at least two ribs are always in contact with the internal surfaces of a well tubing lowering the rotation of the rod.

The foregoing description of the invention is explanatory only and changes in the detail of the construction illustrated may be made by those skilled in the art within the scope of the appended claims without departing from the spirit of the invention.

What is claimed as new and desired to be secured by Letters Patent is:

1. A rod guide on the shank of a rod which is positionable in a well tubing, said guide including: a pair of longitudinally spaced units rigidly secured to the shank, each unit including a tubular elongate body having a middle portion and a pair of end portions extending divergently inwardly from opposite ends of the middle portion to the shank of the rod; a pair of ribs extending from the middle portion in opposite radial directions, the ribs of one unit being displaced relative to the ribs of the other unit about the longitudinal central axis of the rod, a portion of the rod shank between the two units constituting a flex portion of the rod shank.

2. The rod guide of claim 1, wherein the ribs of one unit are displaced 90 degrees relative to the ribs of the other unit.

3. The rod guide of claim 1, wherein the length of said flex portion of the rod shank is not less than ½ inch and not more than 16 inches in length.

4. The rod guide of claim 3, wherein each of said units is formed of a rigid durable substance that rigidifies the portions of the rod shank on which it is mounted.

5. The rod guide of claim 1, wherein each of said ribs has an outer longitudinal surface arcuate in cross section and longitudinal side surfaces extending from the middle portion of the body to said outer surface divergently outwardly whereby the said outer surfaces of said ribs are of greater width than their widths of the ribs at the middle portion of the body.

6. The rod guide of claim 1, wherein said rod guide includes a middle unit positioned between and spaced from said units of said pair of units, said middle unit having a pair of radially oppositely outwardly extending ribs, said ribs of said middle unit being displaced radially relative to the ribs of said units of said pair of units whereby at least two ribs of said rod guide units are in constant engagement with the internal surfaces of a well tubing as the rod shank is rotated through 360 degrees about the central longitudinal axis of the rod shank at locations where the rod shank is displaced laterally from the central longitudinal axis of the well tubing.

7. The rod guide of claim 1 wherein said rod guide includes a middle unit positioned between and spaced from the pair of units, said middle unit having a tubular elongate body having a middle portion and a pair of end portions extending divergently inwardly from opposite ends of said middle portion to the shank of the rod and a pair of radially outwardly oppositely extending ribs, said ribs of said middle unit being displaced radially relatively to the ribs of said units of pair of units, whereby at least two ribs of said rod guide units are in engagement with the internal surface of a well tubing at all times as the rod shank is rotated through 360 degrees about the central longitudinal axis of the rod shank at locations where the rod shank is displaced laterally from the central longitudinal axis of the well tubing in which it is positioned.

8. The rod guide of claim 6, wherein said ribs of said units of said pair of units have an outer longitudinal surface arcuate in cross section which is of greater width than the inner portions of the ribs.

9. The rod guide of claim 7, wherein said ribs of said middle unit units have an outer elongate surface arcuate in cross section and longitudinally substantially parallel side surfaces extending from said outer surface to said middle portion.

10. The rod guide of claim 1, wherein said ribs have an outer elongate surface arcuate in cross section which is greater in width than the portions of the ribs at said middle portion.

* * * * *